United States Patent [19]

McArthur

[11] Patent Number: 4,883,207

[45] Date of Patent: Nov. 28, 1989

[54] VERSATILE SPORTS PACK

[76] Inventor: Patrick D. McArthur, 20763 Schoolcraft, Canoga Park, Calif. 91306

[21] Appl. No.: 227,809

[22] Filed: Aug. 3, 1988

[51] Int. Cl.[4] ..... A45F 4/02; A45F 3/08

[52] U.S. Cl. ..... 224/153; 224/210; 224/228; 224/236; 224/261; 190/113; 383/62

[58] Field of Search ..... 224/151, 153, 202, 207, 224/209-216, 227, 228, 235, 236, 237, 240, 241, 242, 245, 257, 258, 259, 261, 262, 263, 907, 231; 190/107, 108, 110, 113; 383/102, 119, 62; 206/282

[56] References Cited

U.S. PATENT DOCUMENTS

| | | | |
|---|---|---|---|
| 823,058 | 6/1906 | Leavy | 224/241 X |
| 1,806,246 | 5/1931 | Feldman et al. | 190/108 X |
| 3,622,056 | 11/1971 | Droeger | 224/209 X |
| 3,696,850 | 10/1972 | Rosenblum | 150/33 |
| 4,066,195 | 1/1978 | Dickler | 224/210 |
| 4,236,657 | 12/1980 | Brunton | 224/153 |
| 4,424,841 | 1/1984 | Smith | 150/33 |
| 4,449,655 | 5/1984 | Germe | 224/153 |
| 4,752,263 | 6/1988 | Pritchard | 441/88 |

FOREIGN PATENT DOCUMENTS

| | | | |
|---|---|---|---|
| 167038 | 4/1950 | Austria | 224/209 |
| 1010467 | 6/1952 | France | 224/209 |
| 1354399 | 1/1964 | France | 224/210 |
| 2077095 | 12/1981 | United Kingdom | 224/257 |

*Primary Examiner*—Henry J. Recla
*Assistant Examiner*—Robert M. Fetsuga
*Attorney, Agent, or Firm*—Poms, Smith, Lande & Rose

[57] ABSTRACT

A carrying assembly, suitable for use either as a backpack or a piece of luggage, and especially suited for carrying equipment for recreational water sports such as scuba diving, includes a body, having side, top, bottom, front and back walls, defining a storage space within which are disposed a plurality of storage pockets. The body and pockets may be formed of a strong yet flexible and water resistant material to accommodate transport of both wet and dry items. Also, some pockets may be formed of a strong yet flexible mesh material to facilitate rapid drainage and drying of wet items, especially when the storage space is opened to permit free air circulation. Side wall straps are provided for when the assembly is employed in its luggage configuration and rear wall straps are provided for when it is in its backpack mode. When used as luggage, a closable flap covers and secures in place the rear wall straps. When the assembly is used as a backpack, the side wall straps are adjusted to lie flush with the side wall and the flap is opened and stored in a pouch affixed to the bottom body wall. Strong yet resilient L-shaped members are provided and extend along the inside of the rear wall and provide support when the assembly is used as a backpack. A removably secured day pack and briefcase are provided and may serve as additional storage pockets or separate carrying means when the entire assembly is not required.

19 Claims, 5 Drawing Sheets

FIG. 1
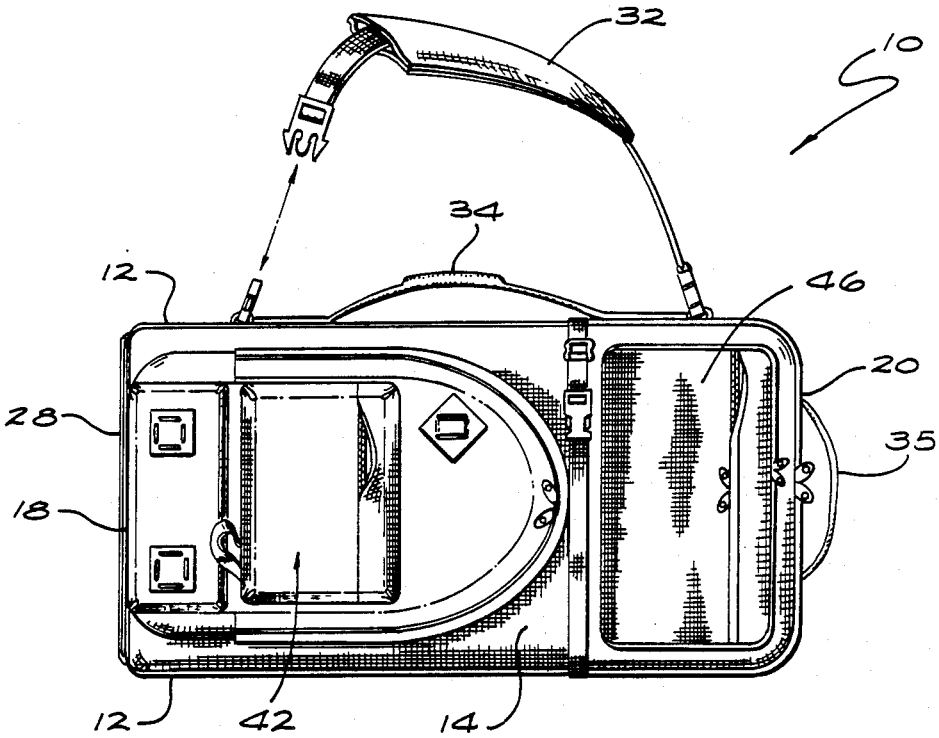
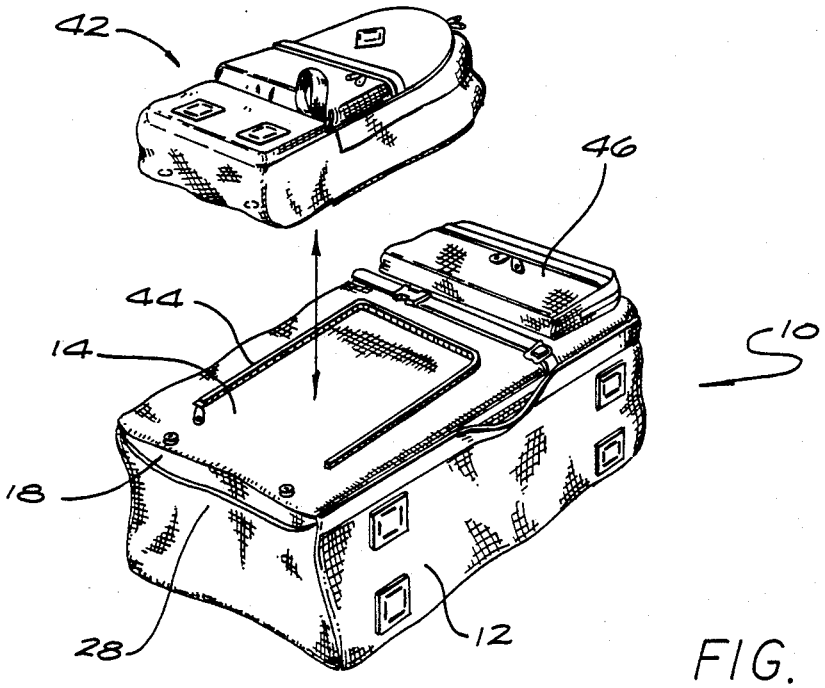
FIG. 2

FIG. 4
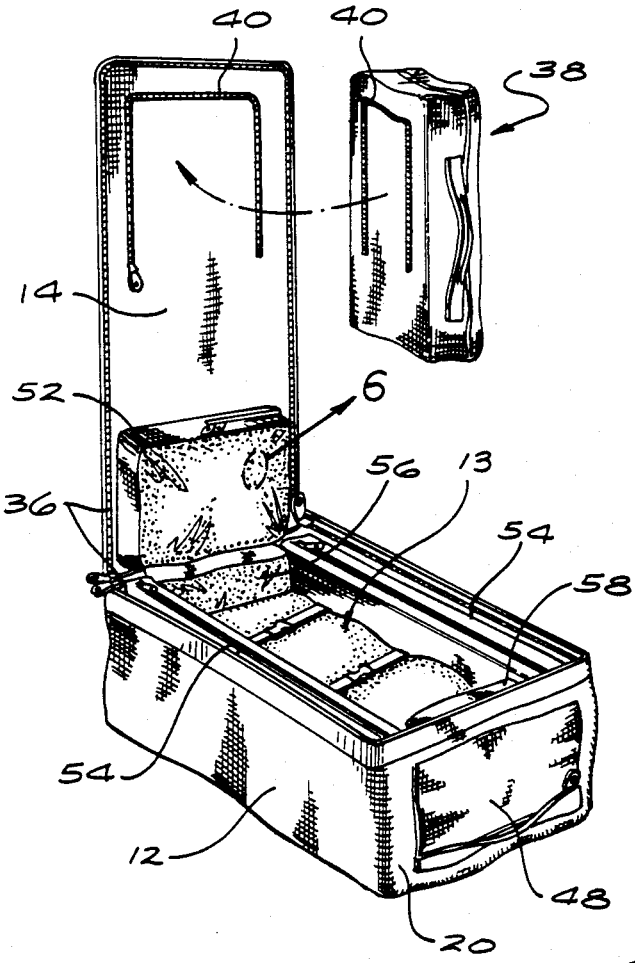
FIG. 3
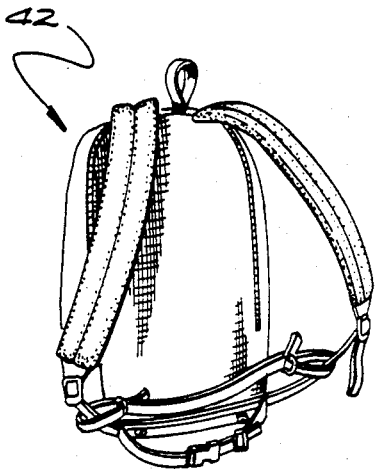
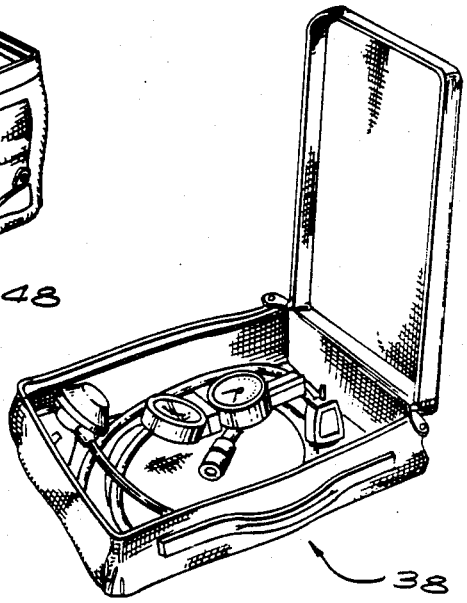
FIG. 5
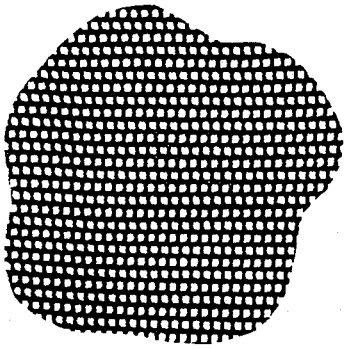
FIG. 6

FIG. 9
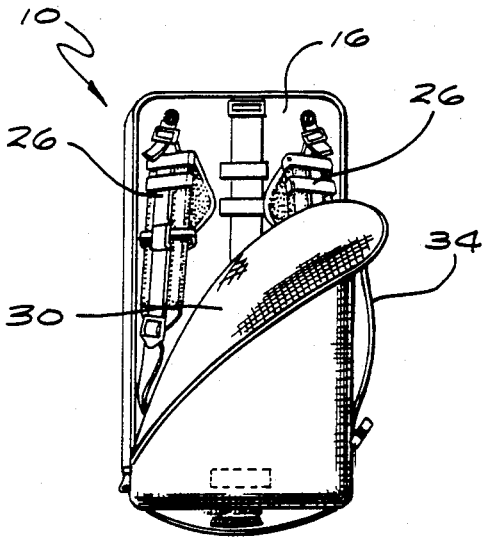
FIG. 10
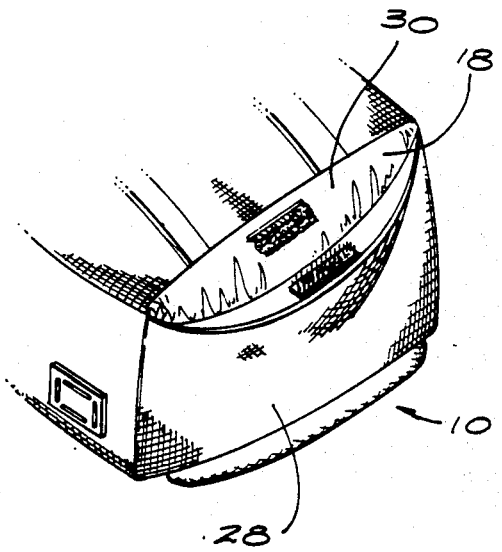
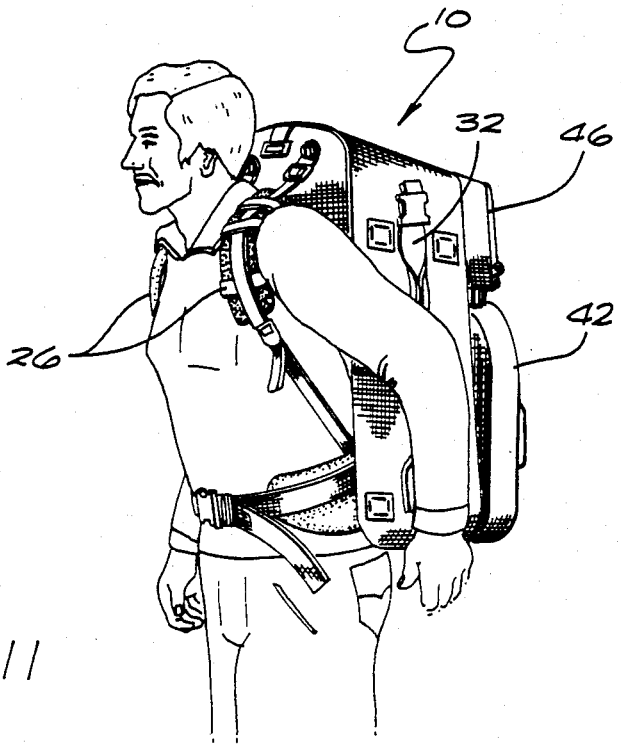
FIG. 11

VERSATILE SPORTS PACK

FIELD OF THE INVENTION:

This invention relates to carrying assemblies that may be used as a piece of hand luggage or converted for use as a backpack.

BACKGROUND OF THE INVENTION:

Certain types of recreational water sports such as scuba diving, snorkeling and similar sports require a considerable amount of specialized equipment such as underwater masks, gloves, wetsuits, swim fins, utility belts, gas regulators and the like. This equipment may be cumbersome or bulky to carry, especially if it has just been used and is in a wet or damp condition.

At the present time, there exists no single means specifically designed for carrying such equipment in both its dry and wet states. Accordingly, an important object of the present invention is to provide a single assembly suitable for carrying such recreational equipment regardless of whether the equipment is wet or dry.

A further aspect of such recreational water sports is that those active in these pursuits often wish to engage in the sports in remote or relatively inaccessible locations. Hence, at any given time, the equipment and accessories needed to engage in such sports may be subjected to a wide variety of different modes of transportation including airplanes, buses, automobiles, other modes of public transport and transportation by foot.

Presently, there exists no single means for carrying such equipment that is suitable for all the various modes of transport to which the equipment may be subjected.

Accordingly, another important object of the present invention is to provide a single assembly suitable for carrying such equipment during all the various modes of transport that the equipment may be subjected to and especially when the equipment must be transported by foot.

Another aspect of transporting such equipment is that when it is in a wet or damp condition it is desirable to dry the equipment out in order to lighten the load that must be carried and to prevent any deterioration of the equipment through prolonged and unnecessary contact with moisture.

Accordingly, yet another object of the invention is to provide a single assembly for carrying such equipment which facilitates the rapid drying-out of the equipment without the need for removing all the equipment from the carrying assembly.

Still another aspect of transporting such recreational equipment is that portions of the equipment are fragile and may require protection during transport to guard against breakage.

Accordingly, a further object of the present invention is to provide a single assembly for carrying such recreational equipment which provides suitable protection from damage or breakage for the fragile portions of the equipment.

SUMMARY OF THE INVENTION:

In accordance with specific embodiments illustrating the principles of the present invention, there is provided a single carrying assembly that may be converted for use as either a piece of hand luggage or as a backpack and which in one embodiment is adapted for use in carrying equipment and accessories associated with recreational water sports such as scuba diving, snorkeling and the like.

The carrying assembly includes a body having top, bottom, front, rear and side walls which define a storage space and within which are disposed a variety of storage pockets for separately storing and organizing some of the items contained in the storage space.

One aspect of this embodiment of the invention is that the body walls of the carrying assembly may be formed of a strong yet flexible and water resistant material. These characteristics result in a carrying assembly whose body provides protection for the items placed in it while simultaneously accommodating both wet and dry items such as may be associated with scuba diving, snorkeling and other recreational water sports.

A further aspect of the invention is that some of the storage pockets may be formed of the same material as the body walls, thereby providing additional protection for fragile or breakable items placed in the pockets as well as facilitating the separation of wet and dry items within the body's storage space.

Yet another aspect of the invention is that some of the storage pockets may be formed of a strong yet flexible mesh material. This material facilitates the rapid drying of wet items placed within the pockets, especially when the carrying assembly is at rest and its storage space is opened to allow air to freely circulate through it. The mesh material also allows items to be dried without the need for removing them from the pockets, thereby guarding against misplacing the items or inadvertently leaving them in some remote location where the carrying assembly and its contents have been put to use.

L-shaped support members are affixed to the rear body wall and provide both protection and support for the items placed within the body's storage space. The L-shaped members may be formed of a hard yet resilient material that is suitable for resting against the back of an individual who is using the carrying assembly in its backpack configuration. One aspect of this embodiment of the invention is that the short portions of the L-shaped members extend along the plane of the bottom body wall. This characteristic provides a support base for items in the storage space when the carrying assembly is used in its backpack configuration thereby preventing sagging and shifting of such items. It also facilitates the ability of the carrying assembly to remain in an upright position when it is resting on the bottom body wall, thereby allowing easy access to items in the storage space and enhancing the drying of wet items placed in the storage space by providing both an increased area of exposure to circulating air and more efficient drainage.

Two adjustable shoulder straps extend along the outside surface of the rear body wall and are affixed to the L-shaped support members through the rear body wall. A third adjustable shoulder strap and a separate hand strap extend along and are affixed to one of the side body walls. A fourth fixed-length hand strap is affixed at the top of the L-shaped members to facilitate carrying the invention short distances in an upright position. All of the straps may be formed of a strong yet flexible and water resistant material such as nylon.

Another aspect of the invention is that when the carrying assembly is in its luggage configuration, the side wall straps are employed to lift and carry the assembly while the rear wall shoulder straps are stored flush with the outside surface of the rear body wall and both held in place and concealed by a closable flap that, when closed, covers the entire outside surface of the rear body wall. In this configuration, the carrying assembly may be employed as an ordinary piece of hand held or shoulder-slung luggage that is suitable for use in all modes of transport that are ordinarily associated with such luggage, such as transport by plane, bus, automobile and the like. In addition, when in this configuration, the carrying assembly continues to provide a single assembly suitable for transporting the specialized equipment associated with recreational water sports such as scuba diving, snorkeling and the like.

A further aspect of the invention is that when the carrying assembly is in its backpack configuration the side wall shoulder strap is adjusted to lie flush with the side wall and the rear wall shoulder straps are employed to carry the assembly on the back of a person using the invention. In this configuration, the carrying assembly provides an efficient and comfortable way to transport materials and equipment by foot, thereby allowing those active in recreational water sports, such as scuba diving, to easily transport the specialized equipment associated with such sports to remote and relatively inaccessible locales. In addition, when in this configuration, the carrying assembly provides a transport device that is suitable for use whenever it is desirable or necessary for the user of the assembly to have both hands free.

A further aspect of the invention is that when the carrying assembly is in its backpack configuration the flap that covers the rear body wall during the luggage configuration may be stored in a sealable pouch that is affixed to the bottom body wall. Both the flap and the pouch may be made of the same strong, flexible, water resistant material as the carrying assembly's body walls. Hence, the pouch provides an added layer of protection to items within the storage space and near the bottom wall. In addition, the flap, when stored in the pouch, adds yet another layer of protection to the carrying assembly.

Another aspect of the invention is that a day pack is provided and is removably secured to the outside surface of the front body wall. The day pack may be formed of the same material as the body of the carrying assembly and the day pack's shoulder straps may be formed of the same material as the straps on the carrying assembly. The day pack may be used either as an additional storage pocket of the carrying assembly or as a separate carrying means when the entire assembly is not required, as when a user wishes to make short excursions away from the location to which the carrying assembly has been transported. A further aspect of this embodiment is that when the day pack is used in its attached configuration it provides additional protection for fragile items in the body's storage space.

Regarding a further aspect of the invention, the front body wall is partially detachable from the body of the carrying assembly thereby allowing access to the body's storage space and the storage pockets disposed therein. As mentioned above, this serves the collateral function of facilitating drying of damp objects in the mesh pockets. A briefcase is removably secured to the inside surface of the front body wall thereby providing an additional storage pocket when in its attached mode and a separate hand held carrying case when in its detached mode.

Concerning yet another aspect of this embodiment of the invention, two large storage pockets are located within the storage space and extend along the inside surfaces of the two side body walls. When the carrying assembly is used to transport the specialized equipment associated with recreational water sports such as snorkeling and scuba diving, these two large storage pockets may be used to store swim fins. When so used, and because of the relatively rigid nature of such fins, the pockets provide excellent protection for items placed in the body's storage space and in particular for items placed in the detachable briefcase, which rests between the two large pockets when the front body wall is fully attached to the carrying assembly.

Another feature of the invention involves the use of a plurality of adjustable straps within the storage space to secure items placed in the storage space, thereby preventing shifting of such items and making it easier to transport the carrying assembly especially when in the backpack configuration.

Other objects, features and advantages of the invention will become apparent from a consideration of the following detailed description and from the accompanying drawings.

BRIEF DESCRIPTION OF THE DRAWINGS

FIG. 1 is a top plan view of a combination luggage and backpack carrying assembly;

FIG. 2 is a side perspective view of the carrying assembly with its detachable day pack in the detached mode;

FIG. 3 is a rear perspective view of the detachable day pack;

FIG. 4 is a side perspective view of the carrying assembly with its main storage compartment open and with its detachable briefcase in the detached mode;

FIG. 5 is a side perspective view of the detached briefcase in its open configuration;

FIG. 6 is a representation of a section of the mesh material that may be used to form portions of the carrying assembly's internal storage pockets;

FIG. 9 is a partial rear elevation view of the carrying assembly with its closable flap partially open;

FIG. 10 is a partial side perspective view of the sealable pouch on the bottom of the carrying assembly; and FIG. 11 is a side perspective view of the carrying assembly in its backpack configuration.

DETAILED DESCRIPTION

Figure 7:
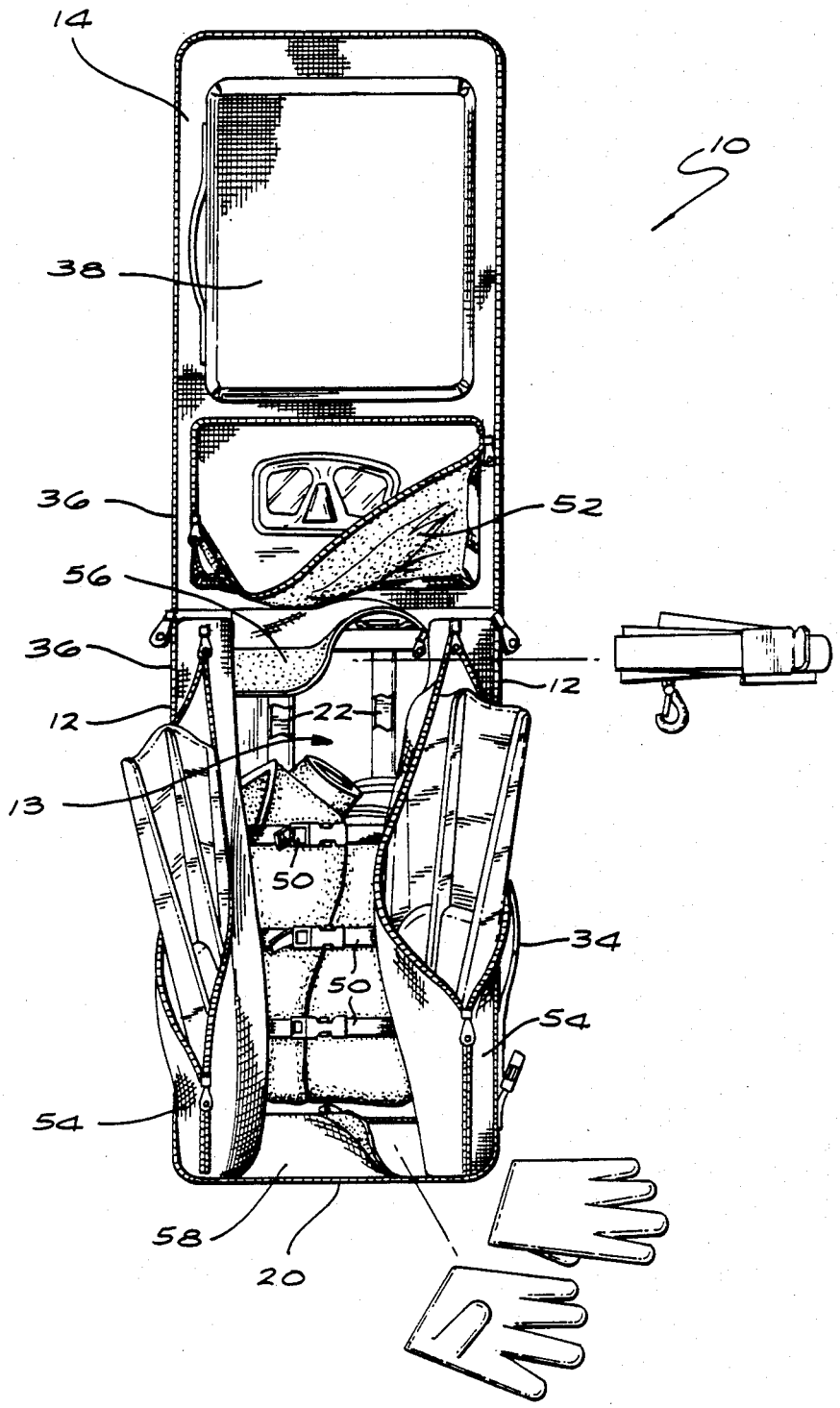
FIG. 7 is a top plan view of the carrying assembly with its main storage compartment open and its internal storage pockets partially open.

Referring more particularly to the drawings, FIG. 1 shows a combination luggage and backpack assembly including a body 10 having side walls 12, a top wall 20, a bottom wall 18, a front wall 14 and a rear wall 16. The rear wall 16 is shown most clearly in FIG. 9. It may be noted that in the preferred embodiment the carrying assembly's body walls are made of a strong yet flexible and water resistant material thereby resulting in a carrying assembly whose body provides protection for items placed inside it while also providing a suitable carrying assembly for both wet and dry items.

As is best seen in FIGS. 4 and 7, the body walls define a storage space 13 within which are disposed a variety of internal storage pockets 52, 54, 56 and 58. The front body wall 14 is partially detachable from the body of the carrying assembly, thereby allowing access to the storage space 13 and internal storage pockets. A front wall zipper assembly 36, or other suitable closure mechanism, provides for the partial detachability of the front body wall 14.

In accordance with one embodiment of the invention, the storage space 13 is provided with: a front wall storage pocket 52 affixed to the inside surface of the front body wall 14 and near the bottom body wall 18; two side wall storage pockets 54 affixed to the inside surfaces of the side body walls 12 and extending nearly all the way from the top body wall 20 to the bottom body wall 18; a bottom wall storage pocket 56 affixed to the inside surface of the bottom body wall 18; and a top wall storage pocket 58 affixed to the inside surface of the top body wall. It may be noted that some of the internal storage pockets may be formed of the same material as the body walls, thereby providing the physical protection and water resistant characteristics previously described.

It may also be noted that some of the internal storage pockets may be formed of a strong yet flexible mesh material, as is illustrated in FIG. 6, to facilitate the rapid drying of wet items placed in the pockets and to allow for drying without the need for removing items from the pockets.

A briefcase 38 is provided and is removably secured to the portion of the inside surface of the front body wall 14 nearest the top body wall 20. A briefcase zipper assembly 40, or other suitable attachment assembly, is provided for removing or securing the briefcase 38 to the inside surface of the front body wall 14. It may be noted that, when the briefcase 38 is in its attached mode and the front body wall 14 is fully attached, the briefcase 38 rests in a portion of the storage space protected on the sides by the two side wall storage pockets 54 and the contents of the pockets. This position provides a maximum amount of protection for any fragile items stored in the briefcase 38.

A plurality of adjustable load stabilization straps 50 are disposed within the storage space 13 and may be used to secure items placed in the storage space 13 thereby preventing shifting of such items and making the carrying assembly generally easier to handle and transport.

Figure 8:
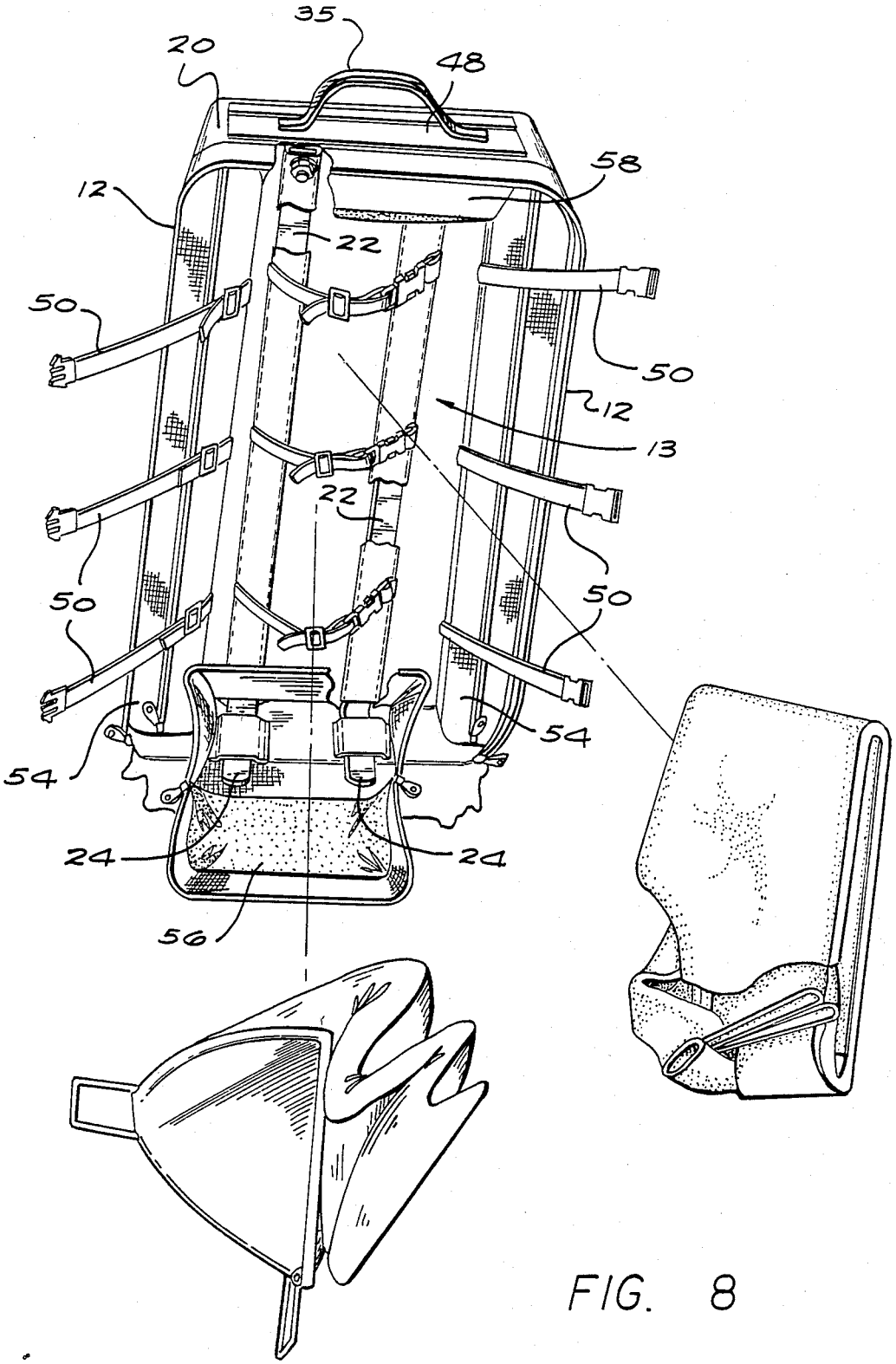
FIG. 8 is a partial front elevation view of the main storage compartment of the carrying assembly.

As is best seen in FIG. 8, the carrying assembly is provided with a plurality of L-shaped support members 22. The support members are affixed to the rear body wall 16 and are positioned parallel to the side body walls 12 and with their short portions 24 extending along the bottom body wall 18. In the preferred embodiment, the L-shaped support members 22 are formed of a hard yet resilient material suitable for resting against the back of an individual using the carrying assembly in its backpack configuration.

As is most clearly seen in FIG. 9, two adjustable shoulder straps 26 extend along the outside surface of the rear body wall 16 and are affixed to the L-shaped support members 22 through the rear body wall 16. Another adjustable shoulder strap 32 and a hand strap 34 extend along and are affixed to the outside surface of one of the side body walls 12. An additional lifting strap 35 is optionally provided at the upper end of the backpack, when it is in the backpack configuration, as shown in FIGS. 1 and 8. It is particularly useful in raising the pack as it is being placed on one's back, and carrying the invention short distances in the upright position.

A closable flap 30 is provided and is affixed to the rear body wall 16 so that, when it is closed, it covers the rear body wall 16, including the adjustable shoulder straps 26, and helps secure the shoulder straps 26 in a relatively fixed position. When the flap 30 is open, it may be stored in a sealable pouch 28 affixed to the bottom body wall 18.

In practice, when the invention is used in a backpack configuration, as is seen in FIG. 11, the side wall adjustable shoulder strap 32 and hand strap 34 are adjusted to lie flat against the side wall 12, the flap 30 is stored in pouch 28, and the rear wall shoulder straps 26 are employed to lift and carry the assembly. When the invention is used in a luggage configuration, as is seen in FIG. 1, the side wall straps 32 and 34 are employed to lift and carry the assembly, and the rear wall straps 26 are adjusted to lie flat against the rear wall 16 and are covered and secured in place by the closing of flap 30.

As may be seen from FIGS. 1 and 2, a day pack 42 is provided and is removably secured to the portion of the outside surface of the front body wall 14 nearest the bottom body wall 18. A day pack zipper assembly 44, or other suitable attachment assembly, is provided for removing or securing the day pack 42 to the outside surface of the front body wall 14. It may be noted that, when it is in its attached configuration, the day pack 42 provides additional layers of protection for items stored in the body's storage space 13.

In accordance with one embodiment of the present invention, external storage pockets 46 and 48 are provided. A top wall storage pocket 48 is affixed to the outside surface of the top body wall, and a front wall storage pocket 46 is affixed to the portion of the outside surface of the front body wall 14 nearest the top body wall 20. As noted hereinabove, these storage pockets may be formed either of the same material as the carrying assembly's body or of a strong, flexible mesh material.

Incidentally, for completeness, reference is made to R. G. Brunton U.S. Pat. No. 4,236,657, granted Dec. 2, 1980 and to Paul F. Dickler U.S. Pat. No. 4,066,195, granted Jan. 3, 1978. The first of these patents discloses a conventional hard surface suitcase provided with two straps so that it may be carried on one's back; and the second relates to a backpack which has a zipper attached separable briefcase. While these patents have rudimentary concepts which are remotely related to certain of the concepts of the present invention, the present Versatile Sports Pack is a complete and integrated assembly which goes far beyond the rudimentary structures of the Brunton and Dickler patent disclosures.

In conclusion it is to be understood that the foregoing description and accompanying drawings relate to only one preferred embodiment of the present invention. Other embodiments may be utilized without departing from the spirit and scope of the invention. Thus, by way of example and not of limitation, the number and disposition of storage pockets, both internal and external, may be varied from that which is detailed above. Also, various parts of the invention could be made of materials other than those discussed herein. While the invention has been described in connection with one intended use, for carrying scuba diving equipment, it could, of course, be employed for carrying other equipment where multiple use luggage and backpacking applications are contemplated. Accordingly, it is to be further understood that the detailed description and drawings set forth hereinabove are for illustrative purposes only and do not constitute a limitation on the scope of the invention.

What is claimed is:

1. A combination luggage and backpack assembly comprising:

a body having side, front, rear, top and bottom walls and defining a storage space;

a plurality of L-shaped support members affixed to said rear body wall and with their short portions extending along said bottom body wall to provide support to the contents of said assembly when it is employed as a backpack;

a plurality of shoulder straps affixed to the outside surface of said rear body wall;

a sealable pouch affixed to the outside surface of said bottom body wall;

a closable flap attached to said rear body wall and adapted to cover the outside surface of said rear body wall, including said shoulder straps, when in its closed position and adapted to be stored in said pouch when in its open position when the assembly is to be used as a backpack;

a shoulder strap affixed to one of said side body walls;

a hand strap affixed to one of said side body walls;

a hand strap affixed to the top of said body walls;

a day pack including means for removably securing said day pack to the outside surface of said front body wall;

means for partially detaching said front body wall from said body thereby permitting access to said storage space;

a briefcase including means for removably securing said briefcase to the inside surface of said front body wall; and a plurality of sealable pockets disposed within said storage space and affixed to the inside surfaces of said body walls.

2. The assembly defined in claim 1 wherein said plurality of sealable pockets include a front wall pocket affixed to the inside surface of said front body wall, two side wall pockets affixed to the inside surfaces of said side body walls, a bottom wall pocket affixed to the inside surface of said bottom body wall, and a top wall pocket affixed to the inside surface of said top body wall.

3. The assembly defined in claim 2 wherein said plurality of sealable pockets includes at least one pocket with one side made of heavy mesh material to allow rapid circulation of air and dissipation of moisture when said means for partially detaching said front body wall is employed to permit access to said storage space.

4. The assembly defined in claim 1 wherein said plurality of sealable pockets includes a front wall storage pocket affixed to the inside surface of said front body wall and wherein said front wall storage pocket has one side made of heavy mesh material to allow rapid circulation of air ad dissipation of moisture.

5. The assembly defined in claim 4 wherein said plurality of sealable pockets includes a bottom wall storage pocket affixed to the inside surface of said bottom body wall and wherein said bottom wall storage pocket has one side made of heavy mesh material to allow rapid circulation of air and dissipation of moisture.

6. The assembly defined in claim 1 wherein said means for removably securing said day pack to the outside surface of said front body wall includes a zipper assembly having one set of teeth affixed to said outside surface of said front body wall and another set of teeth affixed to said day pack.

7. The assembly defined in claim 6 wherein said means for removably securing said briefcase to the inside surface of said front body wall includes a zipper assembly having one set of teeth affixed to said inside surface of said front body wall and another set of teeth affixed to said briefcase.

8. The assembly defined in claim 1 wherein said means for removably securing said briefcase to the inside surface of said front body wall includes a zipper assembly having one set of teeth affixed to said inside surface of said front body wall and another set of teeth affixed to said briefcase.

9. The assembly defined in claim 7 wherein said means for partially detaching said front body wall from said body includes a zipper assembly having one set of teeth affixed to said front body wall and another set of teeth affixed to said body.

10. A combination luggage and backpack assembly comprising:

a body made of a strong yet flexible and water resistant material and having side, front, rear, top and bottom walls defining a storage space;

two hard yet resilient L-shaped support members affixed to said rear body wall and having their short portions extending along the inside surface of said bottom body wall and their long portions extending along the inside surface of said rear body wall;

two adjustable shoulder straps extending along the outside surface of said rear body wall and including means for affixing said shoulder straps to said long portions of said L-shaped members through said rear body wall;

a sealable pouch affixed to the outside surface of said bottom body wall and constituting means for providing additional protection for said storage space;

a closable flap attached to said rear body wall and adapted to cover the outside surface of said rear body wall, including said adjustable shoulder straps, when said flap is in its closed position and adapted to be stored in said pouch when said flap is in its open position;

an adjustable shoulder strap affixed to one of said side body walls;

a hand strap affixed to one of said side body walls;

a hand strap affixed to the top of said body walls;

a day pack made of a strong yet flexible material and including means for removably securing said day pack to the outside surface of said front body wall;

means for partially detaching said front body wall from said body thereby permitting access to said storage space;

a briefcase made of a strong yet flexible material and including means for removably securing said briefcase to the inside surface of said front body wall;

a plurality of sealable pockets, made of strong yet flexible material, disposed within said storage space and affixed to the inside surfaces of said body walls and including at least one pocket with one side made of heavy mesh material to allow rapid circulation of air and dissipation of moisture when said means for partially detaching said front body wall is employed to permit access to said storage space.

11. The assembly defined in claim 10 whereby said plurality of sealable pockets further include two large pockets extending along the inside surfaces of said side body walls and whereby said large pockets include means for providing structural support for said body and resilient protection for items placed in said storage space.

12. The assembly defined in claim 10 whereby said plurality of sealable pockets include a front wall pocket affixed to the inside surface of said front body wall, two side wall pockets affixed to the inside surfaces of said side body wall, a bottom wall pocket affixed to the inside surface of said bottom body wall and a top wall pocket affixed to the inside surface of said top body wall.

13. The assembly defined in claim 12 whereby said front wall pocket and said bottom wall pocket include one side made of heavy mesh material to allow rapid circulation of air and dissipation of moisture when said means for partially detaching said front body wall is employed to permit access to said storage space.

14. The assembly defined in claim 13 whereby said means for partially detaching said front body wall from said body includes a zipper assembly having one set of teeth affixed to said front body wall and another set of teeth affixed to said body.

15. The assembly defined in claim 10 wherein said means for removably securing said day pack to the outside surface of said front body wall includes a zipper assembly having one set of teeth affixed to said outside surface of said front body wall and another set of teeth affixed to said day pack.

16. The assembly defined in claim 15 wherein said means for removably securing said briefcase to the inside surface of said front body wall includes a zipper assembly having one set of teeth affixed to said inside surface of said front body wall and another set of teeth affixed to said briefcase.

17. The assembly defined in claim 10 wherein said means for removably securing said briefcase to the inside surface of said front body wall includes a zipper assembly having one set of teeth affixed to said inside surface of said front body wall and another set of teeth affixed to said briefcase.

18. The assembly defined in claim 16 wherein said means for partially detaching said front body wall from said body includes a zipper assembly having one set of teeth affixed to said front body wall and another set of teeth affixed to said body.

19. The assembly defined in claim 10 whereby said plurality of sealable pockets further include two large pockets extending along the inside surfaces of said side body walls and whereby said large pockets include means for providing structural support for said body and resilient protection for items placed in said storage space.

* * * * *